US008181400B2

(12) United States Patent
Kindschuh

(10) Patent No.: US 8,181,400 B2
(45) Date of Patent: May 22, 2012

(54) GAS FILL DEVICE FOR MULTIPLE PANE WINDOWS

(76) Inventor: Rodney G. Kindschuh, Thornton, CO (US)

( * ) Notice: Subject to any disclaimer, the term of this patent is extended or adjusted under 35 U.S.C. 154(b) by 172 days.

(21) Appl. No.: 12/662,622

(22) Filed: Apr. 26, 2010

(65) Prior Publication Data

US 2010/0287851 A1 Nov. 18, 2010

Related U.S. Application Data

(60) Provisional application No. 61/213,159, filed on May 12, 2009.

(51) Int. Cl.
*E06B 7/00* (2006.01)

(52) U.S. Cl. ..... 52/171.3; 52/788.1; 52/204.52

(58) Field of Classification Search ..... 52/171.3, 52/204.52, 204.593, 209, 302.7, 788.1, 786.1, 52/786.13, 173.1; 49/471; 428/34
See application file for complete search history.

(56) References Cited

U.S. PATENT DOCUMENTS

| | | | | |
|---|---|---|---|---|
| 1,336,211 | A * | 4/1920 | Duffy | 251/309 |
| 2,213,395 | A | 9/1940 | Hopfield | |
| 2,756,467 | A | 7/1956 | Etling | |
| 3,470,049 | A * | 9/1969 | Gotthilf | 156/145 |
| 4,295,305 | A | 10/1981 | Shelver | |
| 4,886,095 | A | 12/1989 | Lisec | |
| 5,027,574 | A * | 7/1991 | Phillip | 52/171.3 |
| 5,139,595 | A | 8/1992 | Taylor | |
| 5,554,421 | A | 9/1996 | Delisle et al. | |
| 5,626,712 | A | 5/1997 | Lisec | |
| 5,792,523 | A | 8/1998 | McHugh, III | |
| 5,957,169 | A | 9/1999 | Trpkovski | |
| 6,397,662 | B1 * | 6/2002 | Alkhoury | 73/31.04 |
| 2003/0097818 | A1 | 5/2003 | Almasy | |

* cited by examiner

*Primary Examiner* — Brian Glessner
*Assistant Examiner* — Brian D Mattei
(74) *Attorney, Agent, or Firm* — Richard C. Litman

(57) ABSTRACT

The gas fill device for multiple pane windows includes a tube installed through the peripheral spacer bar between two glass panes in an insulated glass assembly for a window, door glass, skylight, or the like. An elbow is pivotally attached to the external end of the tube. A supply of an inert, insulating gas may be attached to the elbow to refill the space between the two panes with the insulating gas, as needed. Two such tubes may be installed in each multiple pane window assembly, one to refill the space with insulating gas and the other to vent air from the space to the atmosphere as the space is refilled with the insulating gas. When the multiple pane window has more than two panes, the tube may be branched and supplied through a common elbow.

13 Claims, 4 Drawing Sheets

GAS FILL DEVICE FOR MULTIPLE PANE WINDOWS

CROSS-REFERENCE TO RELATED APPLICATION

This application claims the benefit of U.S. Provisional Patent Application Ser. No. 61/213,159, filed May 12, 2009.

BACKGROUND OF THE INVENTION

1. Field of the Invention

The present invention relates generally to thermally insulated windows and the like, and more particularly to a gas fill device for multiple pane windows enabling the windows to be charged or recharged with insulating gas in the field or after installation.

2. Description of the Related Art

Constantly increasing energy costs have resulted in correspondingly greater interest in conserving energy to reduce those costs. Virtually all new homes and similar structures are required by building codes to include significant insulation and to have insulated windows and other glass assemblies where applicable. Various professional and industrial organizations, e.g., the National Fenestration Rating Council (NFRC), have developed and set energy conservation standards for the products and services provided by their members.

In many instances and locales, financial incentives are in place to encourage builders and owners to install even more energy efficient assemblies than required by code. For example, rebates have been developed for homeowners installing energy conserving components that meet certain standards. In the case of glass door, window, and other units, rebates of up to one thousand five hundred dollars may be provided for owners and builders installing thermally efficient glass units in the building structure. However, the glass panels and assemblies must have a value of at least E=0.3 in order to qualify.

This can be difficult to accomplish with glass, as glass is a notoriously poor thermal insulating material. As a result, various techniques have been developed and used over the years to optimize the thermal insulation of transparent building panels formed of glass, e.g., windows, doors, skylights, etc. The most common means of increasing the thermal insulation of such glass panels and assemblies is by constructing the panel with two (or more) closely spaced sheets of glass that capture one (or more) insulating spaces or volumes therebetween. The interstitial space(s) between the panes is preferably filled with a dry gas of relatively high molecular weight with good thermal insulating properties, e.g., argon, krypton, xenon, etc., or some mixture thereof as desired.

In order to meet the standards imposed by various governmental agencies and professional groups, such multiple pane assemblies must be constructed, sealed, and filled with insulating gas at the manufacturing site. The intent of such rules is that the sealed unit will maintain its integrity from the point of manufacture to installation. However, this is not always the case, and the regulators and manufacturers recognize this. The main problem is that the glass panes used in the construction of such multiple pane assemblies are relatively thin and fragile, and may easily be broken. Once such a multiple pane assembly has been sealed, the gas pressure contained therein is constant. However, the ambient atmospheric pressure is constantly changing. As a result, multiple pane assemblies are provided with very small diameter breather tubes at the time of manufacture, in order to prevent the panes from breaking due to large differential pressures between the trapped gas within the assembly and the ambient atmosphere.

When multiple pane insulated glass panels are transported, they may undergo significant pressure changes. This is particularly true in mountainous areas of the country, e.g., the Rockies and Sierras. Oftentimes the glass assemblies are assembled and sealed at a site in or near a population center generally located at a relatively low altitude. Yet, the assemblies may have to be transported to a site at a relatively high elevation, or transported over a high mountain pass to their site of installation. The breather tubes installed at the time of manufacture allow the insulating gas to escape to avoid window breakage as the altitude increases and ambient pressure decreases correspondingly, but the breather tube also allows ambient air to flow back into the insulating space as the assembly is transported back to a lower altitude and higher air pressure. Thus, much of the insulating gas is lost during transport, resulting in the insulated glass assembly losing much of its thermal efficiency. In more extreme cases the breather tube may become clogged or crimped, thus preventing the interior volume of the insulated glass assembly from equalizing its internal pressure with the ambient atmosphere. This can often lead to one or more of the glass panes shattering, thus destroying the assembly and requiring it to be shipped back to the manufacturer for new glass, resealing, and refilling with a new charge of insulating gas.

Due to the above problems with transport at high elevation, it can be difficult or impossible in many cases for building contractors and window manufacturers to warranty the required thermal efficiency to qualify for rebates for structures constructed in mountainous areas. This clearly penalizes people living in such areas, and moreover produces structures having less energy efficiency than those constructed at lower altitudes. Yet, the colder temperatures generally occurring at higher altitudes require even greater thermal efficiency from structures in order to conserve energy.

Another problem with such multiple pane thermal glass assemblies is that the seal is never perfect, particularly over a few years or more. Aside from the breather tube venting described above, the seal between the spacer bar and the glass to each side thereof will break down over a period of time. When this occurs, the insulating gas dissipates and air (with some water vapor invariably carried therewith) enters the interstitial space between the glass panes. The problem is most clearly manifested in conditions of relatively large temperature differences between the exterior and interior glass panes, causing condensation to occur on the colder glass pane. When this occurs, much of the original insulating value of the assembly has been lost. The only solution has been to remove the entire glass assembly and replace it with a newly manufactured unit.

Thus, a gas fill device for multiple pane windows solving the aforementioned problems is desired.

SUMMARY OF THE INVENTION

The gas fill device for multiple pane windows includes a tube installed through the spacer bar that separates the peripheries of glass panes in an insulated glass panel structure. The tube allows the flow of gas into and from the interstitial space between the panes. The tube allows ambient air to be removed from the interstitial space, and a dry insulating gas (such as argon, krypton, or xenon) to be placed within the space. The tube includes an external elbow that may be turned to align parallel with the plane of the glass assembly when not in use, and to pivot generally normal to the plane of the glass assembly for use in installing gas within the space between glass panes. Various closure means may be applied to the end of the tube and elbow.

The tube may include branches for installation in multiple pane glass assemblies having more than one interstitial space, i.e., three or more sheets of glass with two or more interstitial spaces therebetween. Preferably two tubes are provided in each multiple pane glass assembly, with a vent tube adjacent the upper edge of the assembly and a filler tube located near the bottom of the assembly. The gas fill device enables the installer of the insulated glass assembly to fill and/or replenish the insulating gas within the assembly at the time of installation, and allows the homeowner or contractor to replenish the insulating gas from time to time as required to maintain the insulating properties of the assembly.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a gas fill device for multiple pane windows, i.e., windows having one or more insulating volumes between two or more panes of glass. The term "window" as used herein includes both openable and permanently closed windows, as well as thermally insulated, multiple pane glass assemblies installed in doors, skylights, and other areas.

Figure 1:
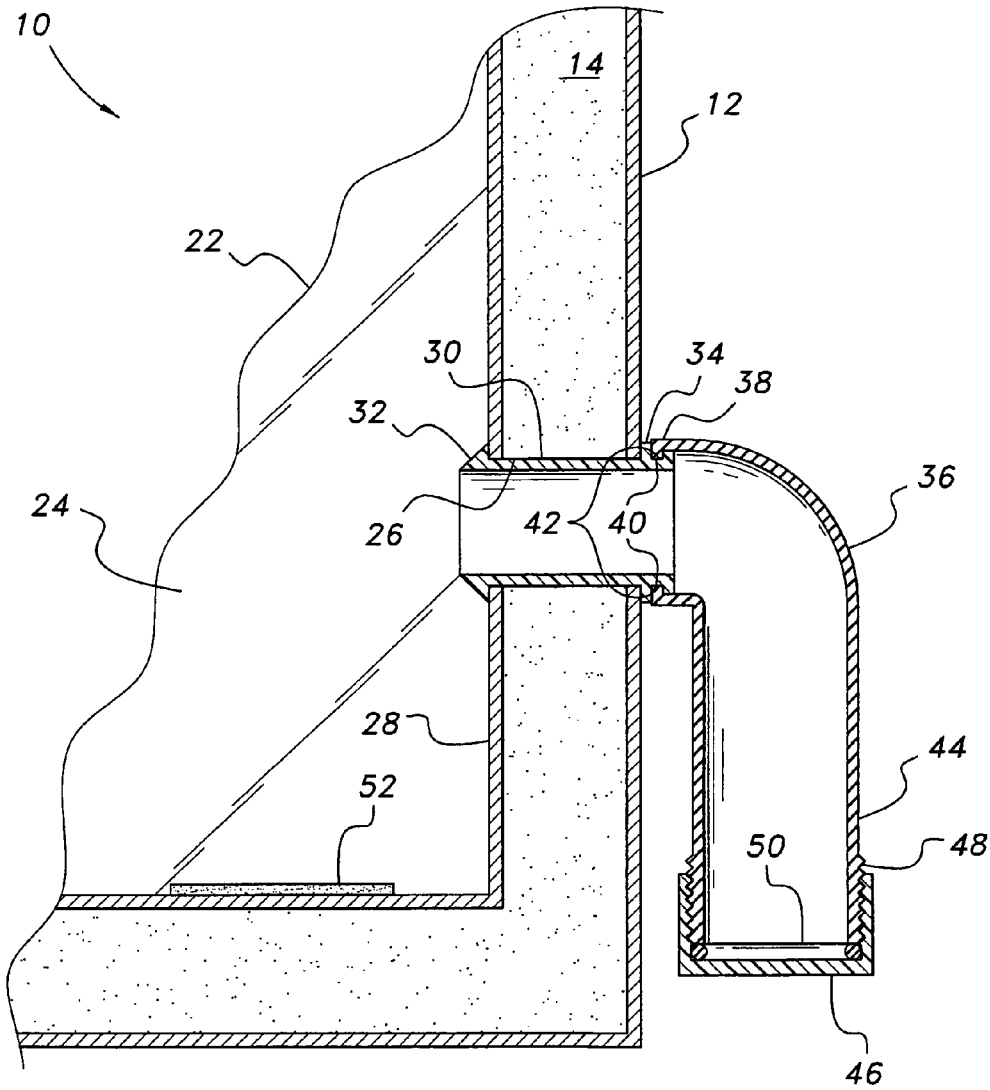
FIG. 1 is an environmental elevation view in section showing a gas fill device for multiple pane windows according to the present invention.
Figure 2:
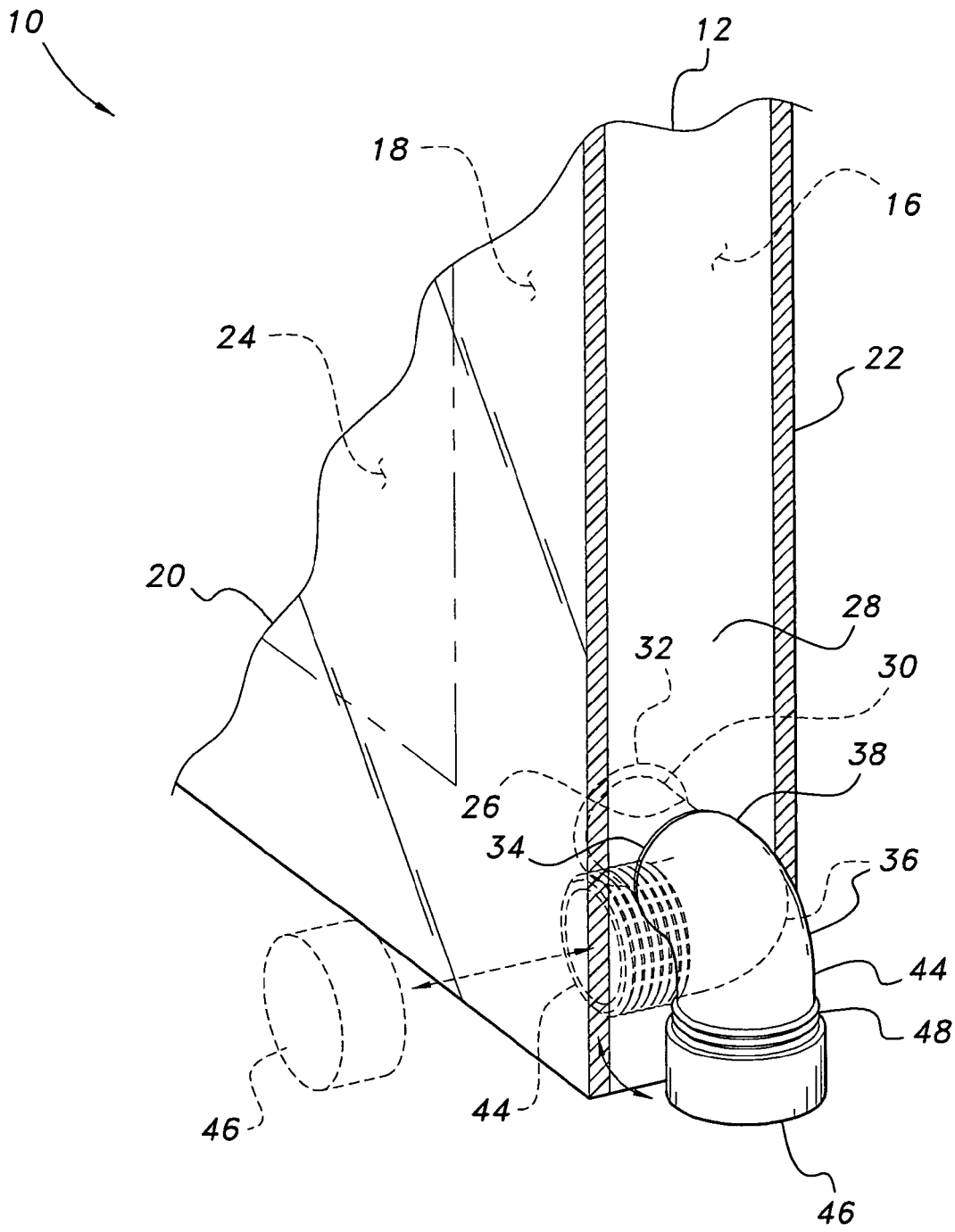
FIG. 2 is a detailed perspective view of the gas fill device of FIG. 1, showing its in-use configuration in broken lines.

FIGS. 1 and 2 of the drawings, respectively, provide a detailed elevation view in section and a perspective view of a broken away corner of an exemplary thermally insulated window assembly 10. Such window assemblies conventionally have a peripheral spacer bar 12 filled with insulating and/or desiccant material 14. The spacer bar 12 includes mutually opposed first and second pane sealing surfaces 16 and 18, as shown in FIG. 2, with corresponding first and second panes 20 and 22 sealed to the surfaces 16 and 18 of the spacer bar 12. Only the second pane 22 is illustrated in FIG. 1, since the section is taken between the first pane 20 and the second pane 22. The spacer bar 12 and the two glass panes 20 and 22 sealed thereto define an insulating volume 24 within the window assembly 10. It should be noted that while the term "sealed" is used to describe the attachment of the glass panes 20 and 22 to the spacer bar 12 captured therebetween, this sealing is imperfect at best and is prone to leakage over a period of time.

The spacer bar 12 includes at least one hole or passage formed therethrough, e.g., the gas fill passage 26 formed in the lower portion 28 of the spacer bar 12 vertical member. A hollow gas fill tube 30 is permanently installed and sealed in place through this passage 26. The tube 30 has a first end 32 having a tapered flange disposed within and communicating with the insulating volume 24 of the window assembly 10, and an opposite flanged second end 34 disposed external to the insulating volume 24. Various installation means may be used, e.g., forming the tube 30 of a resilient plastic material or the like and allowing the tapered flange end 32 to deform as the tube is pushed through the gas fill passage 26, whereupon it expands and locks in place when reaching its fully inserted position. Alternatively, the tube 30 may be installed through the passage 26 from the inside prior to installing at least one of the glass panes 20 or 22, the external flanged end 34 being formed after installation of the tube 30 to hold it in place. A multipiece tube may be manufactured as well, with the two pieces threading or otherwise being secured together within the gas fill passage 26.

A hollow elbow 36 having a substantially ninety degree angle or bend has a first or tube attachment end 38 having an inwardly disposed annular flange 40 that engages a mating radial groove 42 in the second end 34 of the tube 30. This allows the elbow 36 to pivot or rotate relative to the immovably affixed tube 30 sealed through the spacer bar 12. Conventional sealing (not shown), e.g., a resilient gasket, an O-ring, etc., is applied to the joint between the tube 30 and the elbow 36 to produce a substantially gas-tight seal. The elbow 36 may be pivoted outwardly from the plane of the window assembly 10 to facilitate access for filling the window assembly with an insulating gas from time to time, as may be required.

The opposite second end 44 of the elbow 36 includes a removable closure or cap 46. In the example of FIGS. 1 and 2, the internally threaded cap 46 engages mating external threads 48 on the second end 44 of the elbow. A seal, e.g., an O-ring 50, etc., is provided to form a substantially leakproof seal when the cap 46 is installed on the end of the elbow 36.

The device is used to fill the interstitial space or insulating volume 24 of the window assembly 10 with an insulating gas. This may be accomplished at the time of manufacture of the thermally insulating glass panel assembly 10, or at any time prior to, during, or after installation of the panel assembly 10 in a building structure. FIG. 2 provides an illustration of the orientation of the elbow 36 in its stowed position in solid lines, and when oriented for filling the window with gas, as shown in broken lines. Normally, the window assembly 10 is installed within a casement or other structure, with all but the inner surface of the spacer bar 12 concealed by the window frame. The elbow is normally swiveled downwardly or upwardly for compact storage within the window casement.

It is generally easy to determine when ambient air has leaked into the insulating volume of a thermally insulated window system, e.g., the window assembly 10, as condensation will collect within the glass when large temperature differences occur between the inner and outer glass panes. Additional confirmation of the need for gas replenishment may be provided by installing a humidity indicator 52, e.g., a test strip or the like, within the insulating volume 24, as shown in FIG. 1 of the drawings. Such devices are well known and quite economical, and can indicate the presence of moisture by changing color or other means.

When it is necessary to refill the insulating volume with gas, the elbow 36 may be accessed by removing a panel, cover, or other concealing component, if so installed, and swiveling or pivoting the elbow 36 to an orientation generally normal to the plane of the window glass assembly 10, generally as shown in broken lines in FIG. 2. The cap 46 is removed, and a gas delivery line is connected to the now open second end 44 of the elbow 36 to replenish the insulating gas within the window assembly. When this has been accomplished, the cap 46 is reinstalled, the elbow 36 is pivoted back to its stored orientation, and any cover plate or concealing panel is replaced.

Figure 3:
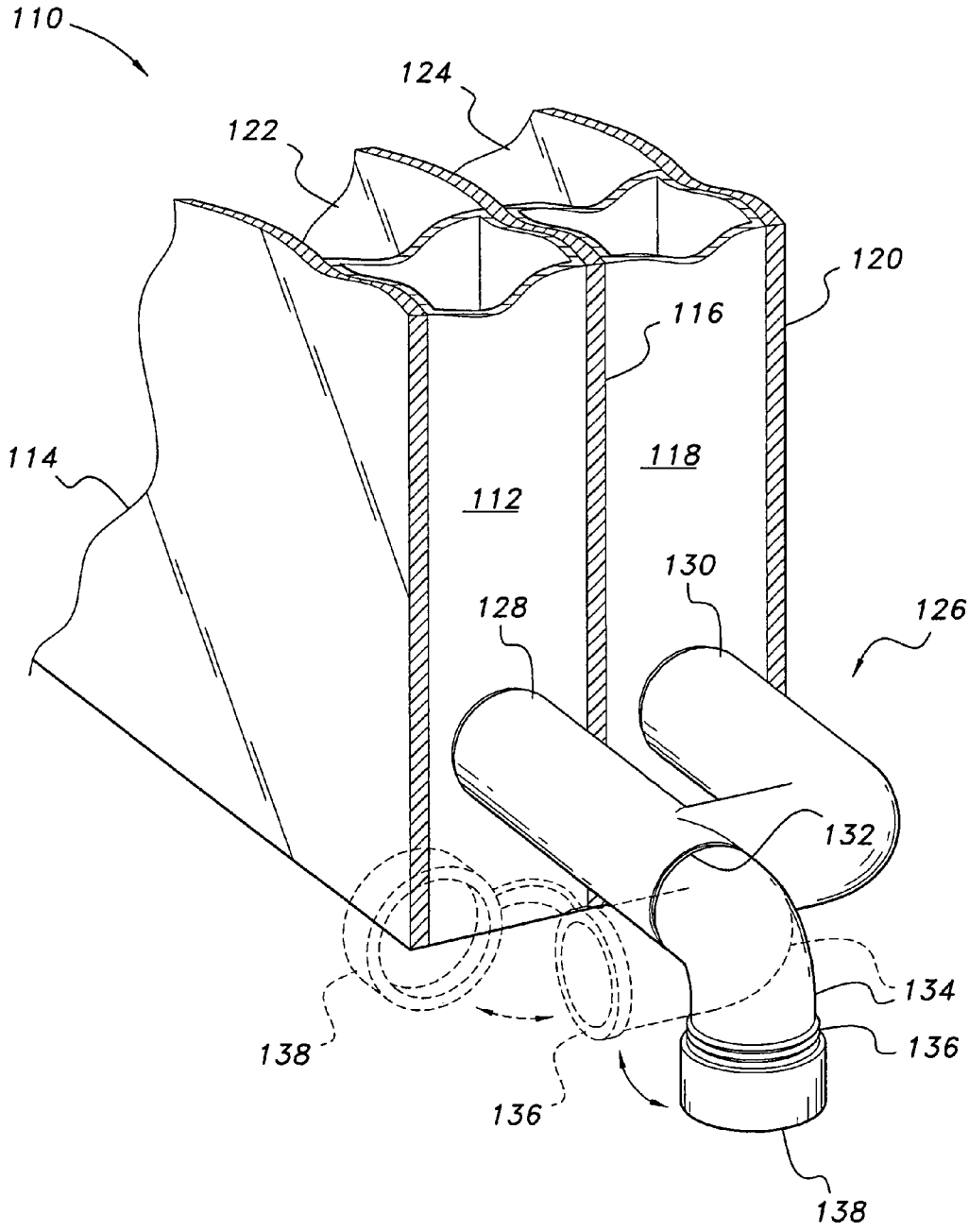
FIG. 3 is a detailed perspective view of an alternative embodiment of a gas fill device for multiple pane windows according to the present invention configured for a triple pane window.

FIG. 3 provides a detail perspective view of a broken away corner of a triple pane thermally insulated window assembly 110. The window assembly 110 is similar to the window assembly 10 of FIGS. 1 and 2, but includes another glass pane and spacer bar to provide two insulating volumes. Accordingly, the window assembly 110 comprises a first spacer bar 112 with opposite first and second glass panes 114 and 116 sealed peripherally thereto, a second spacer bar 118 sealed to the periphery of the second pane 116 to capture the periphery of the second pane between the two spacer bars 112 and 118, and a third pane 120 sealed to the second spacer bar 118, with the second spacer bar 118 captured between the second and third panes 116 and 120. This results in two thermal insulating volumes, with the first volume 122 between the first and second panes 114 and 116 and the second volume 124 between the second and third panes 116 and 120.

The hollow gas fill tube 126 includes a bifurcated first end, with a first branch 128 passing through the first spacer bar 112 and a second branch 130 passing through the second spacer bar 118. The specifics of the installation and sealing may be the same as described further above for the single tube 30 of FIGS. 1 and 2. The two branches 128 and 130 join one another outside the first and second insulating volumes 122 and 124 of the window assembly 110. The tube 126 may have a generally U-shaped configuration as shown, with the open second end 132 extending from one of the two branches, or may comprise a generally Y-shaped and symmetrical configuration.

A hollow elbow 134 extends from the open second end 132 of the tube 126 and is pivotally attached thereto, generally in the manner described further above for the tube 30 and elbow 36 assembly of FIGS. 1 and 2. The elbow 134 includes a distal or capped end 136 having a snap-on type cap 138 removably affixed thereto. The cap 136 may include a flexible tether or the like, if so desired, and includes conventional sealing means (not shown) to preclude substantial gas leakage therefrom. It will be seen that the cap 136 configuration may be used with the single tube 30 configuration shown in FIGS. 1 and 2, and the threaded cap 46 configuration of FIGS. 1 and 2 may be applied to the bifurcated tube 126 and elbow 134 assembly of FIG. 3, if so desired.

Figure 4:
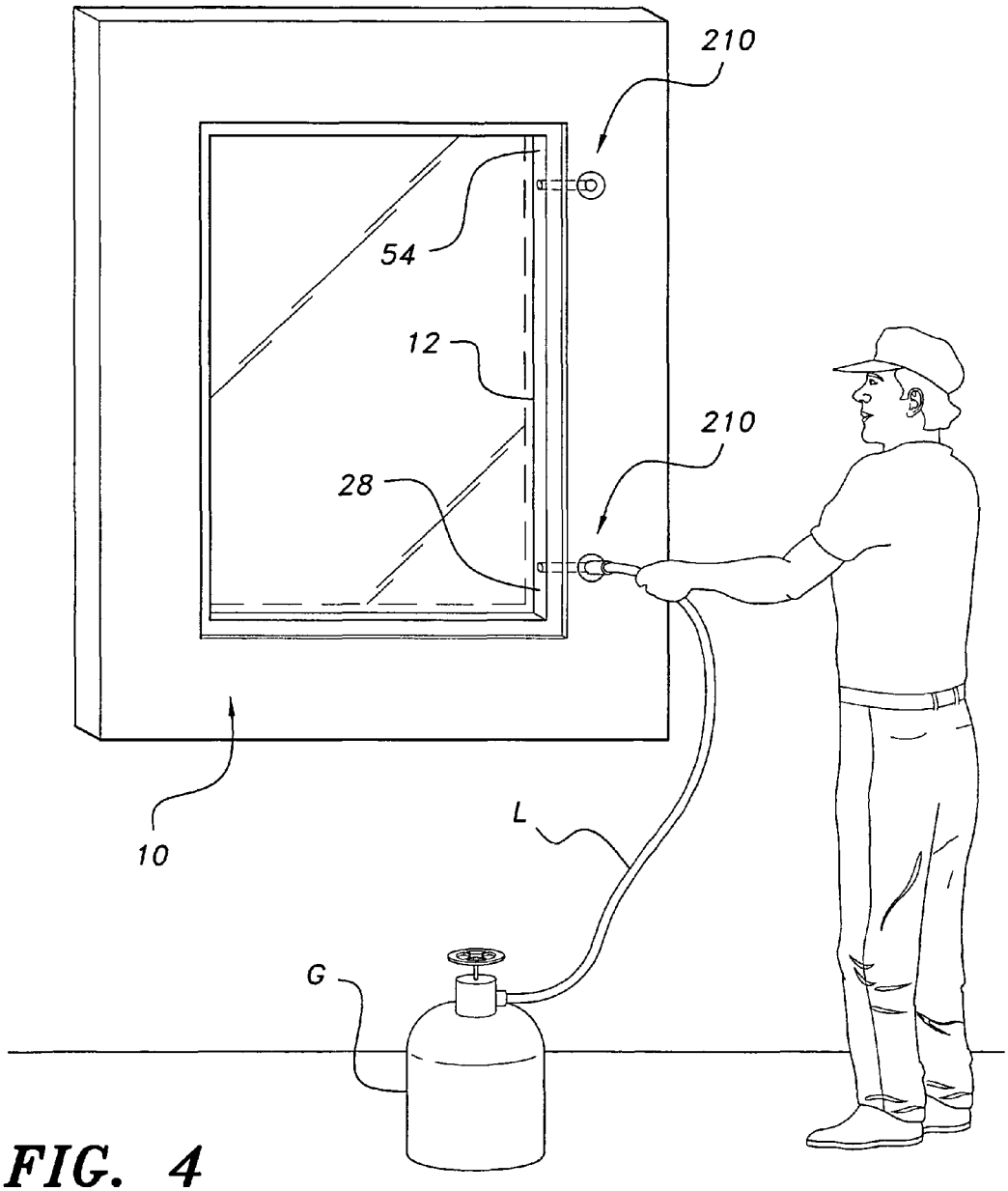
FIG. 4 is an environmental perspective view of a gas fill device for multiple pane windows according to the present invention, showing both a fill device and a vent device installed therein and the window being serviced.

To this point, only a single gas fill tube preferably installed in the lower portion(s) of the spacer bar(s) has been described. However, it is preferable that there be one tube installed relatively low in the window assembly, and a second tube installed near the top of the window assembly, as shown in FIG. 4 of the drawings. This is because the insulating gas (argon, krypton, xenon, etc.) is more dense than air, thus allowing the insulating gas to be added to the interior volume of the window assembly from the lower tube to fill the insulating volume from bottom to top, pushing the lighter air outwardly through the upper tube.

FIG. 4 illustrates such a system, in which a gas fill tube, elbow, and cap assembly 210, e.g., a tube 30, elbow 36, and cap 46 similar to those components illustrated in FIGS. 1 and 2, is installed in the lower portion 28 of the spacer bar 12 in the window assembly 10. A similar or essentially identical tube, elbow, and cap assembly 210 is installed in the upper portion 54 of the spacer bar 12, serving as a vent tube assembly. Upper and lower tube assemblies, similar to that shown in FIG. 3, may be installed with triple pane window assemblies having two insulating volumes or cavities.

The window unit 10 is serviced by providing a supply of insulating gas G in a suitable container. The elbows of the assemblies 210 are pivoted away from the plane of the window for access and their caps, e.g., cap 46 of the assembly illustrated in FIGS. 1 and 2, are removed from both the lower and upper tube assemblies 210 to allow free flow of gas into and from the interior volume of the window assembly 10. The gas supply G is connected to the lowermost fitting 210 via a flexible delivery line L or other suitable means, and the valve of the supply is opened to allow insulating gas to flow into the insulating volume of the window assembly 10 through the lower tube assembly 210.

The gas fills the volume of the window assembly 10 from bottom to top, with ambient air exiting the volume from the upper or vent fitting assembly 210. (Alternatively, the gas supply could be connected to the upper fitting assembly, with the lower fitting assembly used as the vent.) When substantially all of the ambient air has been flushed from the insulating volume of the window 10, the upper cap is reinstalled and the supply line L removed and the lower cap installed to seal the fresh charge of insulating gas within the window assembly 10. The elbows of the tube assemblies 210 are rotated to clear the outer panel of the window, and any cover panels, decorative caps, etc. may then be reinstalled to conceal the tube, elbow, and cap assemblies.

The above-described process for filling or refilling the insulating volume of a thermally insulated window assembly assumes that the window assembly is installed in a building structure. However, it will be seen that the apparatus and method described herein may be applied to newly constructed multiple pane windows at the site of manufacture, or may be applied to newly delivered window assemblies when they have arrived at their destination for installation. In this manner, thermally insulated window assemblies may be subjected to significant pressure changes without fear of damage, as they may remain unsealed until delivered. Once the insulating gas has been added to the insulating volume(s) of the window, the gas fill and vent tubes are sealed shut with their caps, providing an essentially sealed window unit comparable to a multiple pane window assembly filled with insulating gas at the manufacturing site.

It is to be understood that the present invention is not limited to the embodiments described above, but encompasses any and all embodiments within the scope of the following claims.

I claim:

1. A gas fill device for a multiple pane window, comprising:

at least one gas fill tube adapted for permanent installation through a spacer bar separating the multiple panes, the gas fill tube having a first end communicating with an insulating volume of gas disposed between the multiple panes and having a second end opposite the first end, the second end being disposed external to the insulating volume of gas and includes a radial, annular groove;

a hollow elbow pivotally attached to the second end of the at least one gas fill tube, the elbow having a first end communicating with the second end of the gas fill tube and a second end opposite the first end, wherein the first end defines an inwardly disposed annular flange sized and configured to pivotally mate with the radial groove of the second end of the gas fill tube; and a closure removably sealed to the second end of the elbow.

2. The gas fill device for multiple pane windows according to claim 1, wherein the tube has a bifurcated first end defining a first branch and a second branch, the first branch and second branch being joined adjacent the second end.

3. The gas fill device for multiple pane windows according to claim 1, wherein the closure is selected from the group consisting of threaded caps and snap-on caps.

4. The gas fill device for multiple pane windows according to claim 1, further comprising a multiple pane window having:

at least one peripheral spacer bar, the spacer bar having mutually opposed first and second pane sealing surfaces;

a first window pane sealed to the first pane sealing surface; and a second window pane sealed to the second pane sealing surface, the spacer bar and the panes defining an insulating volume therebetween.

5. The gas fill device for multiple pane windows according to claim 4, wherein:

the spacer bar has a lower portion and an upper portion;

the gas fill tube with the attached elbow and the attached closure is installed in the lower portion of the spacer bar; and the multiple pane window further includes a vent tube, a vent elbow connected to the vent tube, and a vent cap assembly attached to the vent elbow to form a vent assembly, the vent assembly being installed in the upper portion of the spacer bar.

6. The gas fill device for multiple pane windows according to claim 4, further including at least one humidity indicator disposed within the insulating volume of the window.

7. The gas fill device for multiple pane windows according to claim 1, further comprising a multiple pane window having:

a first spacer bar;

a first pane and a second pane sealed to the spacer bar, capturing the first spacer bar therebetween and defining a first insulating volume;

a second spacer bar, sealed to the second pane; and a third pane sealed to the second spacer bar, capturing the second spacer bar between the second pane and the third pane and defining a second insulating volume.

8. The gas fill device for multiple pane windows according to claim 7, wherein said hollow tube has a bifurcated first end defining a first branch and a second branch, the first branch extending through the first spacer bar and the second branch extending through the second spacer bar, the first branch and the second branch being joined together external to the first and second insulating volumes.

9. A double-pane window, comprising:

a first window pane;

a second window pane equal in size to the first window pane, the second window pane being disposed parallel to the first window pane;

at least one spacer bar extending around the first and second window panes, the first and second window panes being sealed to the at least one spacer bar to define an enclosed space between the window panes;

an inert gas having thermal insulation properties disposed in the enclosed space;

a gas delivery tube extending through the spacer bar and communicating with the enclosed space, the gas delivery tube having a first end communicating with the inert gas and having a second end opposite the first end, the second end being disposed external to the inert gas and includes a radial, annular groove;

an elbow pivotally attached to the gas delivery tube external to the spacer bar, the elbow having a first end communicating with the second end of the gas delivery tube and a second end opposite the first end, wherein the first end defines an inwardly disposed annular flange sized and configured to pivotally mate with the radial groove of the second end of the gas delivery tube; and a cap releasably attached to the elbow, the elbow being adapted for connection to a supply of the thermal insulation gas when the cap is removed in order to refill the enclosed space with the gas when needed.

10. The double-pane window according to claim 9, wherein said cap comprises a threaded cap, the elbow having corresponding threads.

11. The double-pane window according to claim 9, wherein said cap comprises a snap-on cap.

12. The double-pane window according to claim 9, further comprising a vent tube extending through said at least one spacer bar, the vent tube communicating with the enclosed space, the vent tube having a removable cap.

13. The double-pane window according to claim 9, further comprising at least one humidity indicator disposed within the enclosed space.

* * * * *